US005540572A

United States Patent [19]

Park et al.

[11] Patent Number: 5,540,572

[45] Date of Patent: Jul. 30, 1996

[54] STRUCTURE FOR PREVENTING AXIAL LEAKAGE IN SCROLL COMPRESSOR

[75] Inventors: Jong H. Park, Gwangmyung; Byung C. Lee, Seoul, both of Rep. of Korea

[73] Assignee: Goldstar Co. Ltd., Seoul, Rep. of Korea

[21] Appl. No.: 352,068

[22] Filed: Nov. 30, 1994

[30] Foreign Application Priority Data

Dec. 3, 1993 [KR] Rep. of Korea ..... 26388

[51] Int. Cl.[6] ..... F04C 18/04

[52] U.S. Cl. ..... 418/55.5; 418/55.6; 418/57

[58] Field of Search ..... 418/55.5, 57, 55.6

[56] References Cited

U.S. PATENT DOCUMENTS

| | | | |
|---|---|---|---|
| 3,924,977 | 12/1975 | McCullough | 418/55.5 |
| 4,300,875 | 11/1981 | Fisher et al. | 418/57 |
| 4,764,096 | 8/1988 | Sawai et al. | 418/55.5 |
| 5,192,202 | 3/1993 | Lee | 418/55.5 |
| 5,199,862 | 4/1993 | Kondo et al. | 418/55.5 |
| 5,362,218 | 11/1994 | Fukanuma et al. | 418/55.5 |

*Primary Examiner*—John J. Vrablik

[57] ABSTRACT

The present invention provides a structure for preventing an axial leakage in a scroll compressor. The structure prevents a fixed scroll from rotating on its own axis or swinging in its radial direction, when the fixed scroll is pushed toward an orbiting scroll by refrigerant pressure in a discharge chamber, thereby the axial leakage is precluded. The structure includes a plurality of guide holes formed at the outer circumferential portions of a fixed scroll, and a plurality of projections formed at the outer circumferential portions of a main frame and inserted into the guide holes respectively, so as to allow a sliding movement of the fixed scroll in its radial direction.

14 Claims, 6 Drawing Sheets

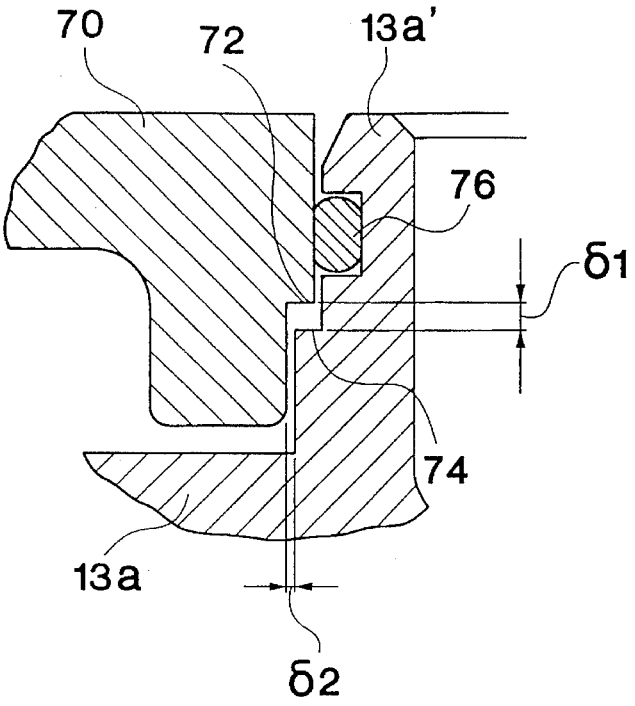
FIG. 6
FIG. 7A
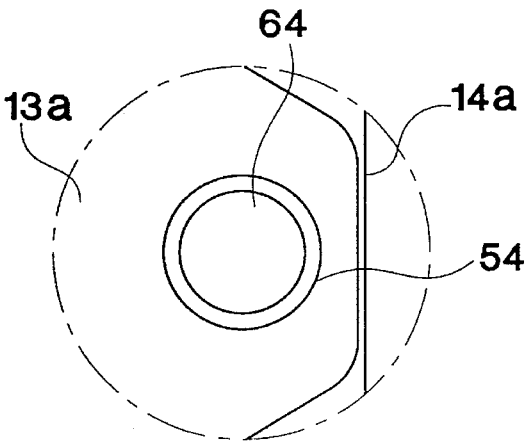
FIG. 7B
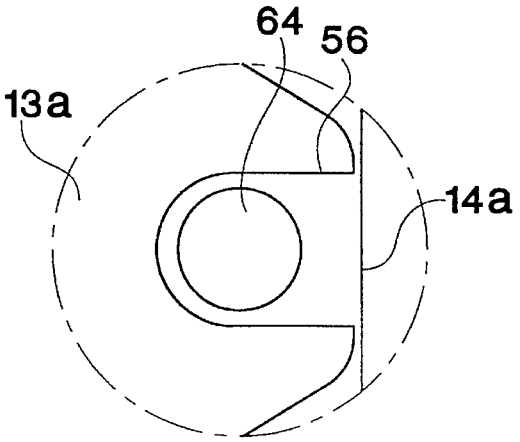
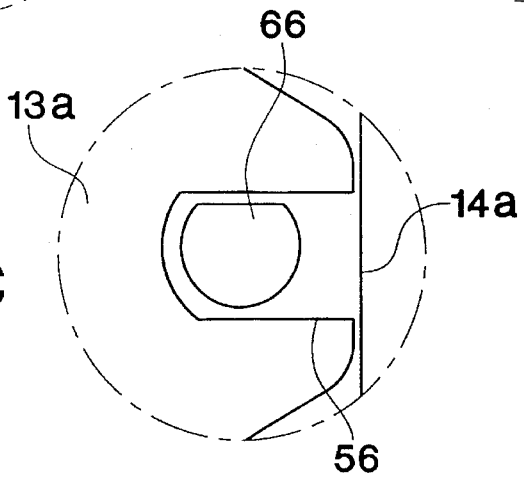
FIG. 7C

STRUCTURE FOR PREVENTING AXIAL LEAKAGE IN SCROLL COMPRESSOR

BACKGROUND OF THE INVENTION

The present invention relates to a structure for preventing an axial leakage in a scroll compressor, and more particularly to a structure for preventing a fixed scroll from rotating on its own axis or swinging in a radial direction.

As shown in FIGS. 1 and 2, a conventional scroll compressor includes (a) a stator 2 mounted in a housing 1, (b) a rotor 3 rotated by a magnetic force of the stator 2 and fixed to a crankshaft 4, (c) an orbiting scroll 12 fixed to the upper end of the crankshaft 4, (d) a fixed scroll 13, facing the upper surface of the orbiting scroll 12, attached to a main frame 14 by bolted leaf springs 8, (e) a discharge hole 11 through which a high pressure refrigerant is discharged from a compression chamber 9 formed between the orbiting scroll 12 and the fixed scroll 13, and (f) a discharge chamber 10 holding the refrigerant which is discharged through the discharge hole 11. The fixed scroll 13 includes a back pressure chamber 7 with a uniform cross section at its top side, and a back pressure hole 6 which emits a portion of the refrigerant in the process of compression.

In the foregoing, when the stator 2 is activated, the rotor 3 and the crankshaft 4 rotate, thereby rotating the orbiting scroll 12. Accordingly, the refrigerant which is drawn through a suction pipe 5 is discharged through the discharge hole 11 to the discharge chamber 10, by the pressure of the compression chamber 9. Generally, the crankshaft 4 rotates about 2 to 3 times during the suction and discharge process of the refrigerant.

As the above, when the refrigerant drawn from the suction pipe 5 is compressed, there are two different types of refrigerant leakage, from a high pressure pocket to a low pressure pocket. The first type is called an axial leakage, where there is leakage into gaps between the tips of scroll wraps and the bottom of opposing scroll. The second type is called a radial leakage, where there is leakage into gaps between opposing scroll wraps.

As described above, to prevent the axial leakage, the next structure is provided. The fixed scroll 13 is fixed to the main frame 14 by bolted leaf springs 8, the back pressure chamber 7 with a uniform cross section is formed at the top side of the fixed scroll 13, and a portion of the refrigerant in the process of compression is emitted into the back pressure chamber 7 through the back pressure hole 6, thereby the pressure of the back pressure chamber 7 becomes constant. The, the fixed scroll 13 moves downward by the back pressure applied to the fixed scroll 13, thereby the gaps between the tips of scroll wraps and the bottom of opposing scroll are minimized, thus the axial leakage is minimized.

However, because the axial leakage is prevented by the pressure of the back pressure chamber 7, a power loss occurs, as shown in FIG. 3. In FIG. 3, an area S depicts the power loss due to compression chamber communicating with the back pressure hole.

Since the fixed scroll 13 is fixed to the main frame 14 by the leaf springs 8, the design of the leaf springs 8 becomes complicated. Also, the assembly process becomes complicated because there are numerous parts.

SUMMARY OF THE INVENTION

It is an object of the present invention to provide a structure for preventing an axial leakage in a scroll compressor. The structure includes a plurality of guide holes formed at the outer circumferential portions of a fixed scroll, and a plurality of projections formed at the outer circumferential portions of a main frame and inserted into the guide holes respectively, so as to allow a sliding movement of the fixed scroll in a radial direction.

Accordingly, the structure prevents a fixed scroll from rotating on its own axis or swinging in a radial direction, when the fixed scroll is pushed toward an orbiting scroll by refrigerant pressure in a discharge chamber, thereby axial leakage is precluded.

Since the pressure of the discharge chamber is utilized in place of the pressure of a conventional back pressure chamber, a power loss does not occur. Also, because leaf springs are not necessary, the assembly process becomes simple and the number of parts are minimized.

BRIEF DESCRIPTION OF THE DRAWINGS

FIG. 6 is an enlarged view of A in FIG. 4 as well as a similar region in a scroll compressor wherein the holes and projections are reversed as in FIG. 5B; and FIGS. 7A through 7C are enlarged partial plan views showing the other embodiments according to the present invention, wherein the projections are on the main frame and the guide holes are in the fixed scroll.

DETAILED DESCRIPTION OF THE INVENTION

Figure 1:
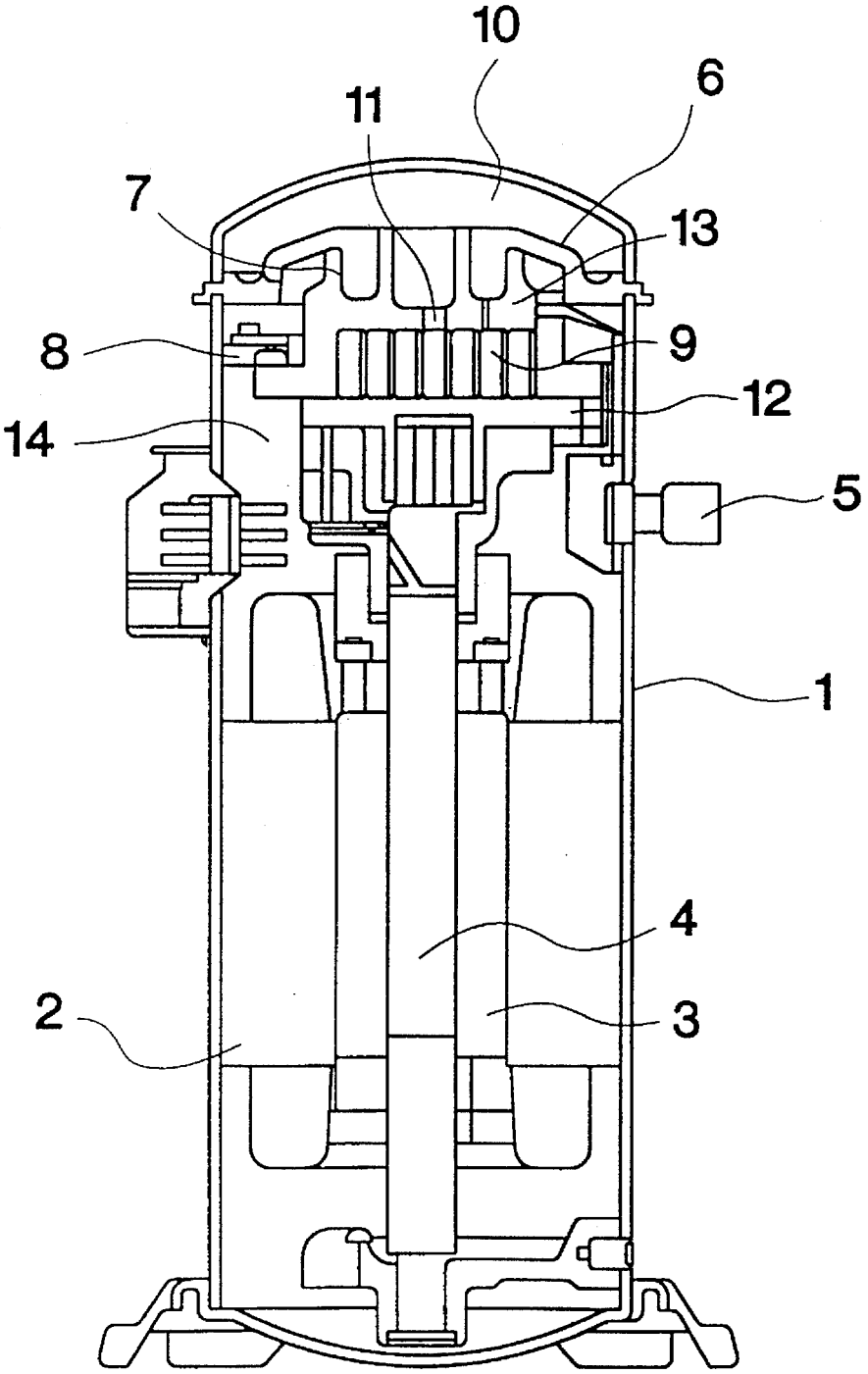
FIG. 1 PRIOR ART
FIG. 1 is a vertical sectional view of a conventional scroll compressor.
Figure 2:
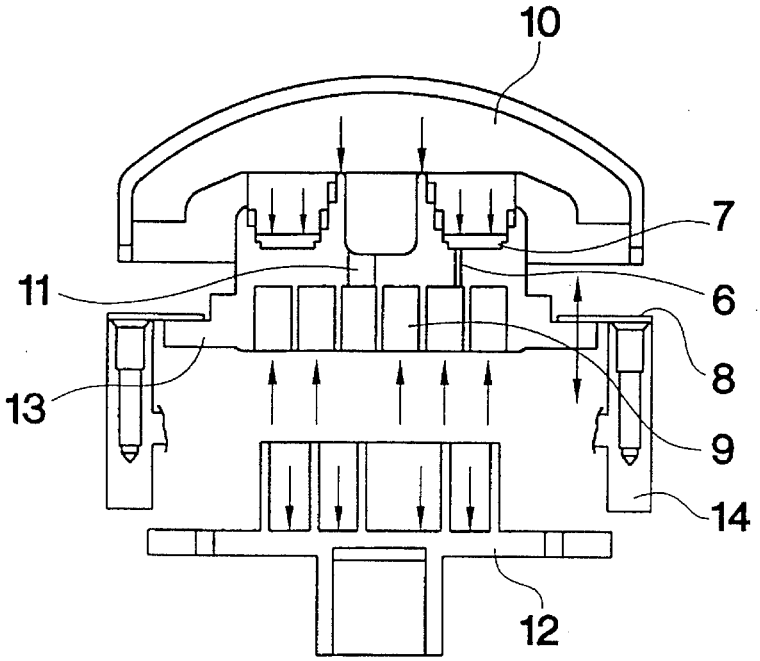
FIG. 2 PRIOR ART
FIG. 2 is a vertical sectional view of a conventional structure for preventing axial leakage in a scroll compressor.
Figure 3:
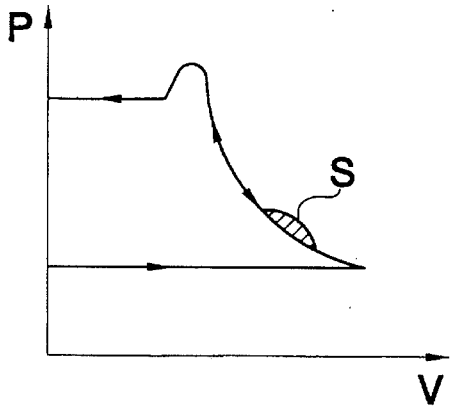
FIG. 3 PRIOR ART
FIG. 3 is a PV diagram of a conventional scroll compressor.

Preferred embodiments of the present invention are described in detail hereinafter with reference to FIGS. 4 through 7.

A scroll compressor according to the present invention includes (a) an orbiting scroll 12 rotated by a crankshaft 4, (b) a fixed scroll 13*a* assembled rotatably to the orbiting scroll 12, (c) a compression chamber 9 formed between the orbiting scroll 12 and the fixed scroll 13*a*, (d) a discharge hole 11 through which a high pressure refrigerant is discharged from a compression chamber 9, (e) a discharge chamber 10 holding the refrigerant which is discharged through the discharge hole 11, (f) an upper wall 70 disposed on the fixed scroll 13*a*, and (g) a seal element 76 inserted between the upper wall 70 and a boss 13*a*' of the fixed scroll 13*a*.

Figure 4A:
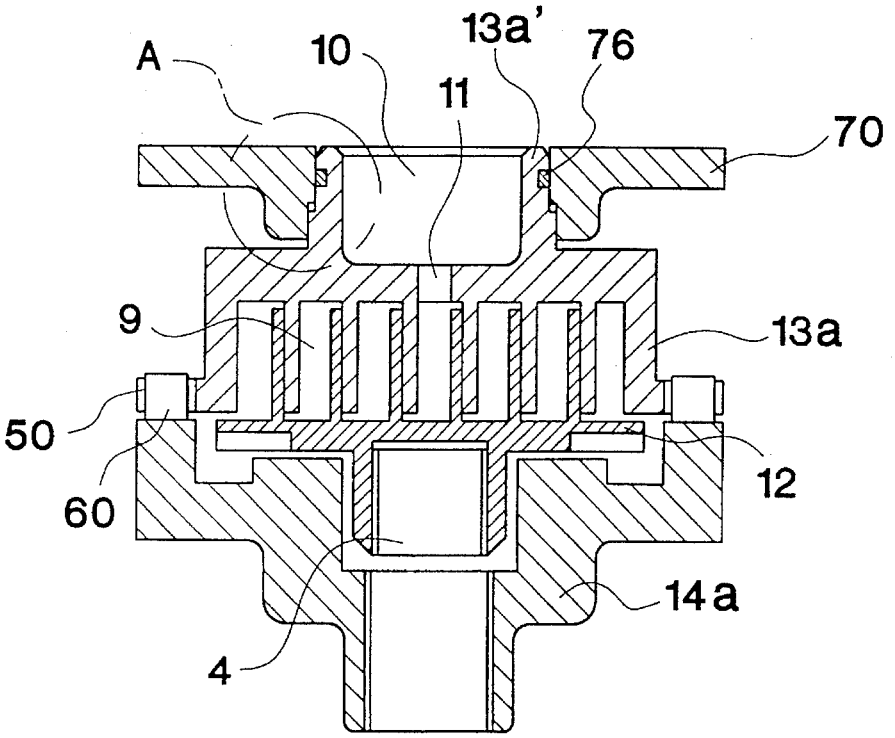
FIGS. 4A and 4B are vertical sectional views of a structure for preventing axial leakage in a scroll compressor according to the present invention.

As shown in FIG. 4A, the structure for preventing an axial leakage in a scroll compressor comprises a plurality of guide holes 50 formed at outer circumferential portions of an fixed scroll 13*a*, and a plurality of projections 60 formed at outer circumferential portions of a main frame 14*a* and inserted into the guide holes 50 respectively, so as to allow a sliding movement of the fixed scroll 13*a* in its radial direction. On the contrary, as another embodiment, it is also possible that the structure for preventing an axial leakage in a scroll compressor comprises a plurality of guide holes formed at the outer circumferential portions of the main frame, and a plurality of projections formed at the outer circumferential portions of the fixed scroll and inserted into the guide holes respectively. In addition clearances δ3 between the projections and the guide holes are in the range of allowance for sliding (shown in FIG. 5A).

Figure 4B:
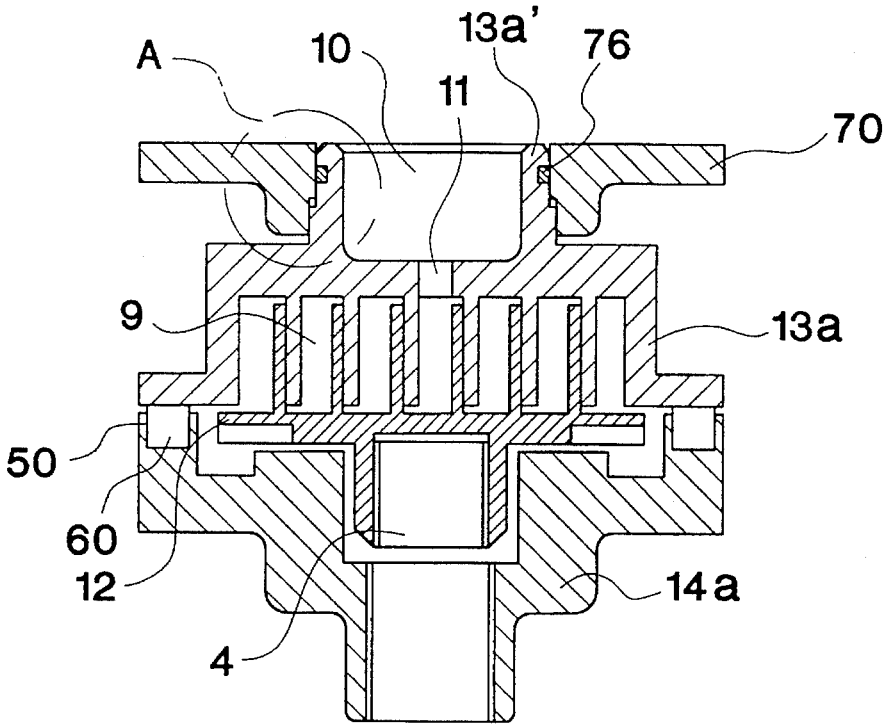

As shown in FIG. 4B, the guide holes and projections may be reversed so as to be formed at outer peripheral portions of the main frame 14*a* and fixed scroll 13*a*, respectively.

Figure 5A:
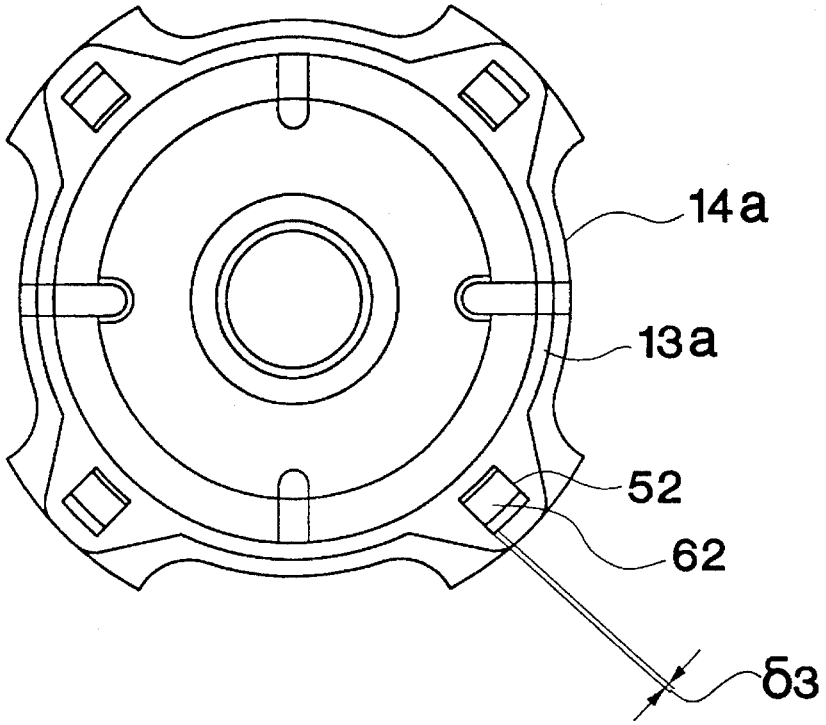
FIGS. 5A and 5B are plan views of a fixed scroll assembled to a main frame, of a scroll compressor according to the present invention.

As shown in FIG. 5A, as for one embodiment, projections 62 on the main frame and guide holes 52 in the fixed scroll are formed so as to have two sides that are parallel and connected by two sides that are arcuate.

Figure 5B:
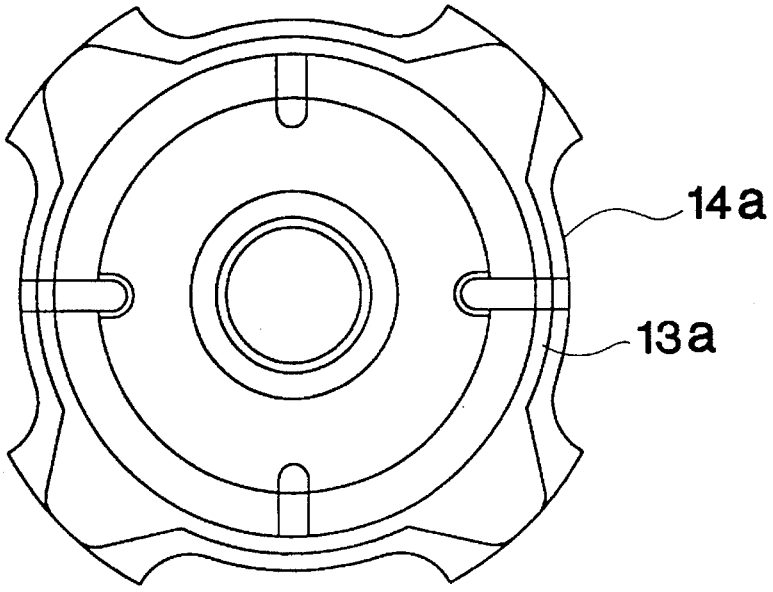

As shown in phantom in FIG. 5B for a single peripheral portion, the projections and guide holes may be reversed so that projections 62 on the fixed scroll and guide holes 52 in the main frame are formed so as to have two sides that are parallel and connected by two sides that are arcuate.

As for another embodiment, as shown in FIG. 7A, projections 64 are formed in a circular shape, and guide holes 54 are formed in an oval shape.

As for yet another embodiment, as shown in FIG. 7B, the projections 64 are formed in the circular shape, and guide holes 56 are an oval shape concaved.

Figure 8A:
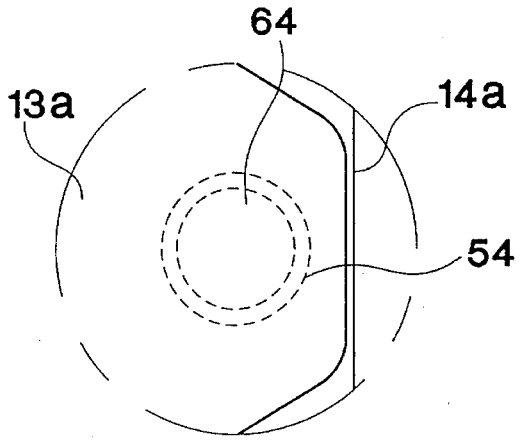
FIGS. 8A through 8C are enlarged partial plan views showing still other embodiments according to the present invention wherein the projections are on the fixed scroll and the guide holes are in the main frame.
Figure 8B:
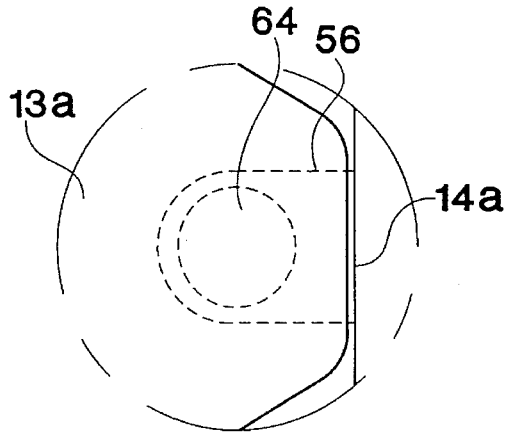
Figure 8C:
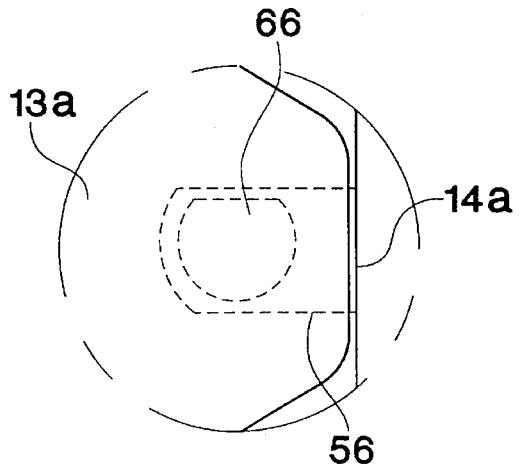

As for a further embodiment, as shown in FIG. 7C, the guide holes 56 are the oval shape concaved, and each circular shaped projection 66 has a flat surfaced, on one side and is in contact with one side of each guide hole 56. As shown in FIGS. 8A–8C, which correspond to FIGS. 7A–7C, respectively, the projections and guide holes may be reversed so that the projections are on the fixed scroll 13*a* and the guide holes are formed at outer circumferential portions of the main frame 14*a*.

On the other hand, as shown in FIG. 6, the structure for preventing an axial leakage in a scroll compressor further comprises a first step 72 formed at the upper wall 70, and a second step 74 formed at the fixed scroll 13*a*. A gap δ1 is defined between the steps 72 and 74, so as to determine a maximum displacement of an axial movement of the fixed scroll 13*a*.

In the foregoing, the refrigerant which is drawn through a suction pipe 5 is discharged through the discharge hole 11 to the discharge chamber 10 by the pressure of the compression chamber 9. The refrigerant in the discharge chamber 10 flows through a high pressure hole (not shown) to a gas pressure chamber (not shown), formed at the upper wall 70. The refrigerant filled the gas pressure chamber pushes downward the fixed scroll 13*a*, thereby minimizing gaps between the tips of scroll wraps and the bottom of opposing scroll, consequently preventing axial leakage.

During the rotation of the orbiting scroll 12, the fixed scroll 13*a* is inclined to rotate by the rotation of the orbiting scroll 12 and spiral flow of the refrigerant existing between the scrolls 12 and 13*a*. However, the rotation of the fixed scroll 13*a* is suppressed by the projections 60 and the guide holes 50. Also, because the clearances δ3 are formed between the projections 60 and the guide holes 50, the rotation of the fixed scroll 13*a* is limited within the clearances δ3. To prevent wear and damage of parts by sudden rotation of the fixed scroll 13*a* on its own axis, a lubricant is filled between the projections 60 and the guide holes 50.

There are two gaps δ1 and δ2 in between the fixed scroll 13*a* and the upper wall 70. The gap δ1 determines the limits of the axial movement of the fixed scroll 13*a*, and is necessary to decrease a starting load, because the fixed scroll 13*a* is raised by the pressure of the refrigerant. In this case, the limit of the gap δ1 is determined in consideration of a compressor's capacity. The gap δ2 minimizes non-symmetrical external force, i.e. pressure of the refrigerant which is in the process of compression, preventing the fixed scroll 13*a* from rocking on the axial line, thereby increasing stability in the fixed scroll 13*a*.

As the above, the structure prevents a fixed scroll from rotating on its own axis or swinging in its radial direction, when the fixed scroll is pushed toward an orbiting scroll by refrigerant pressure in a discharge chamber, thereby the axial leakage is precluded.

While specific embodiments of the invention have been illustrated and described wherein, it is to be realized that modifications and changes will occur to those skilled in the art. It is therefore to be understood that the appended claims are intended to cover all modifications and changes as fall within the true spirit and scope of the invention.

What is claimed is:

1. A scroll compressor comprising:

a main frame having outer circumferential portions;

a fixed scroll having outer circumferential portions and attached for sliding movement in a radial direction to the main frame;

an orbiting scroll having an upper surface which faces said fixed scroll;

a crankshaft mounted to said orbiting scroll;

a stator connected to said main frame for creating a magnetic field;

a rotor rotated by a magnetic force created by said stator, said rotor connected to said crankshaft;

a back pressure chamber disposed on a side of said fixed scroll opposite said orbiting scroll;

a plurality of guide holes formed to have a different opening dimension radially with respect to a center axis of said scroll compressor as compared to circumferentially, said guide holes being located at the outer circumferential portions of the fixed scroll; and a plurality of projections formed at the outer circumferential portions of the main frame, each inserted into a respective one of said guide holes and sized so as to suppress rotation of the fixed scroll but allow a sliding movement of said fixed scroll in a radial direction.

2. A scroll compressor comprising:

a main frame having outer circumferential portions;

a fixed scroll having outer circumferential portions and attached for sliding movement in a radial direction to the main frame;

an orbiting scroll having an upper surface which faces said fixed scroll;

a crankshaft mounted to said orbiting scroll;

a stator connected to said main frame for creating a magnetic field;

a rotor rotated by a magnetic force created by said stator, said rotor connected to said crankshaft;

a back pressure chamber disposed on a side of said fixed scroll opposite said orbiting scroll;

a plurality of guide holes formed to have a different opening dimension radially with respect to a center axis of said scroll compressor as compared to circumferentially, said guide holes being located at the outer circumferential portions of the main frame; and a plurality of projections formed at the outer circumferential portions of the fixed scroll, each inserted into a respective one of said guide holes and sized so as to suppress rotation of said fixed scroll but allow a sliding movement of said fixed scroll in a radial direction.

3. The scroll compressor according to claim 1, wherein said projections and said guide holes each have two sides that are straight and parallel and are connected by sides of different but constant radial dimension.

4. The scroll compressor according to claim 2, wherein said projections and said guide holes each have two sides that are straight and parallel and are connected by sides of different but constant radial dimension.

5. The scroll compressor according to claim 1, wherein said projections are in a circular shape, and said guide holes are in an oval shape.

6. The scroll compressor according to claim 2, wherein said projections are in a circular shape, and said guide holes are in an oval shape.

7. The scroll compressor according to claim 1, wherein said guide holes of said fixed scroll have two sides that are straight and parallel, and one side, which connects said parallel sides, which is arcuate.

8. The scroll compressor according to claim 2 wherein said guide holes of said main frame have two sides that are straight and parallel to each other, and one side which connects said parallel sides, which is arcuate.

9. The scroll compressor according to claim 7, wherein each said projection has a flat surface on one side.

10. The scroll compressor according to claim 8, wherein said each projection has a flat surface on one a side.

11. The scroll compressor according to claim 1, further comprising:

a first step formed at an upper wall; and a second step facing said first step, formed at said fixed scroll, wherein a gap is defined between said steps, so as to determined a maximum displacement of an axial movement of said fixed scroll.

12. The scroll compressor according to claim 2, further comprising:

a first step formed at an upper wall; and a second step facing said first step, formed at said fixed scroll, wherein a gap is defined between said steps, so as to determine a maximum displacement of an axial movement of said fixed scroll.

13. The scroll compressor as claimed in claim 1, and further including a lubricant between respective pairs of the plurality of projections and holes.

14. The scroll compressor as claimed in claim 2, and further including a lubricant between respective pairs of the plurality of projections and holes.

* * * * *